United States Patent [19]

Lane

[11] Patent Number: 4,901,386

[45] Date of Patent: Feb. 20, 1990

[54] AIR ADJUSTABLE WATER MATTRESS

[76] Inventor: Walter W. Lane, Route 1, Roca, Nebr. 68430

[21] Appl. No.: 305,467

[22] Filed: Feb. 1, 1989

[51] Int. Cl.[4] ..... A47C 27/08

[52] U.S. Cl. ..... 5/450; 5/451; 5/464

[58] Field of Search ..... 5/450, 451, 453, 455, 5/464

[56] References Cited

U.S. PATENT DOCUMENTS

| | | | |
|---|---|---|---|
| 2,748,399 | 6/1956 | Rockoff | 5/455 |
| 3,456,270 | 7/1969 | Weinstein et al. | 5/451 |
| 3,803,647 | 4/1974 | Reswick | 5/450 |
| 4,094,025 | 6/1978 | Nystad | 5/451 X |
| 4,109,333 | 8/1978 | Zmiarovich | 5/450 |
| 4,169,295 | 10/1979 | Darling | 5/453 |
| 4,310,936 | 1/1982 | Benjamin | 5/450 |
| 4,558,476 | 12/1985 | Linder | 5/451 X |
| 4,751,757 | 6/1988 | Moreno | 5/450 |

*Primary Examiner*—Michael F. Trettel
*Attorney, Agent, or Firm*—Kinney & Lange

[57] ABSTRACT

An air adjustable waterbed mattress which is adapted to support one or more persons on a sleeping surface. An air chamber unit is contained within a liquid-filled bladder and extends from one side of the bladder toward the other. On inflation, the air chamber unit supports a bladder-formed sleeping surface with the amount of support being determined by the amount of inflation. One or more air chamber units may be selectively positioned within the bladder and each unit is preferably formed of multiple chambers.

11 Claims, 1 Drawing Sheet

AIR ADJUSTABLE WATER MATTRESS

BACKGROUND OF THE INVENTION

1. Field of the Invention.

The present invention relates to waterbeds and, more particularly, to an air adjustable water mattress.

2. Background of the Prior Art

From their initial introduction for medical purposes, waterbeds have gained increasing acceptance as sleeping furniture in private homes . In their early form, waterbeds consisted of little more than a bladder which was filled with water to constitute a mattress. This bladder was confined within a bed foundation to define a sleeping surface on which the user would lie.

Over time, improvements in waterbed construction have led to soft-sided waterbeds and heaters for the water, as well as various devices to reduce or eliminate wave action of the water within the bladder. Wave reduction technology has included the utilization of bonded polyester fibers, typically in sheet form, which is contained within the mattress-forming bladder, as well as devices which are known as "hydraulic" devices. The latter include baffle-like structures suspended within the mattress to obstruct wave motion. Other improvements relate to the elimination or reduction of leakage from the mattress-forming bladder.

SUMMARY OF THE INVENTION

The present invention provides an improvement to a waterbed mattress which may be employed in conjunction with any of the waterbed improvements noted above. Specifically, the present invention provides an air adjustable waterbed mattress which is adapted to support one or more persons on a sleeping surface, the sleeping surface being established by a confined, liquid-containing bladder. The sleeping surface extends between nominal head and foot areas and has opposing side areas.

An air chamber is contained within the liquid-containing bladder and extends from one of the sleeping surface side areas toward the other side area. The air chamber is selectively inflatable to adjust the firmness of that portion of the sleeping surface overlying the inflatable air chamber. The adjustable portion of the sleeping surface may include any portion of the area between the head and foot areas of the sleeping surface. Alternatively, or additionally, one side of the sleeping surface may be selectively adjustable independently of the other side of the sleeping surface. A pump is employed to selectively establish the inflation level of the air chambers.

DETAILED DESCRIPTION OF THE PREFERRED EMBODIMENTS

Figure 1:
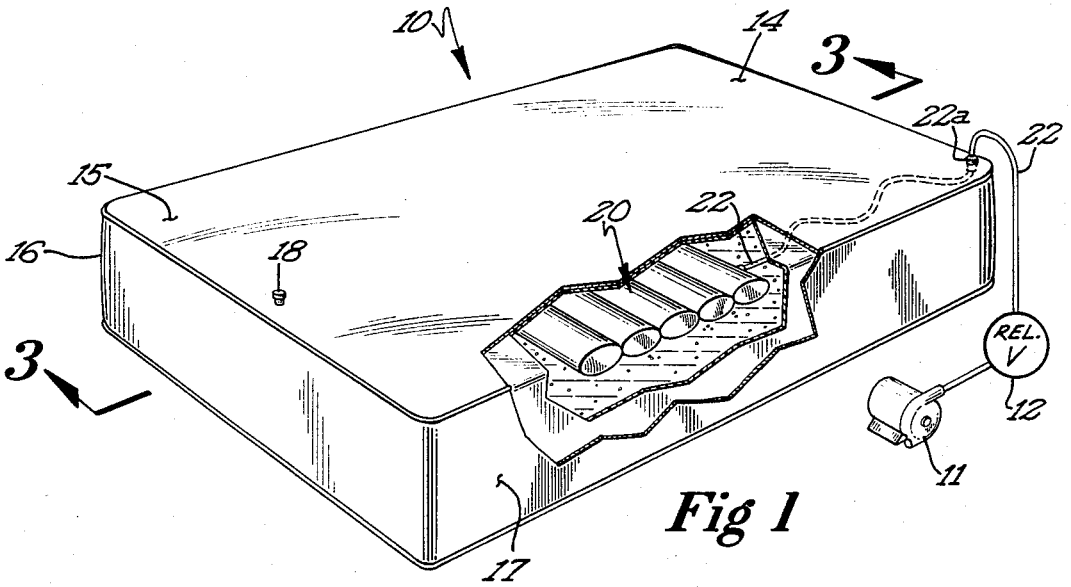
FIG. 1 is a perspective and partial cutaway illustrating a preferred embodiment of the present invention.

FIG. 1 is a perspective and partial cutaway illustrating a preferred embodiment of the present invention including a waterbed mattress generally designated at 10, a pressure relief valve 11 and a pump 12. The waterbed mattress may be of any type known to the prior art, including those generally discussed above, all of which are typically formed by a liquid-containing bladder that is confined to provide a sleeping surface (the upper surface of the bladder) having nominal head 14, foot 15 and opposing side areas 16 and 17, respectively. A valve 18 is provided in the foot area of the sleeping surface for the purpose of introducing liquid (water) into the mattress-forming bladder as well as for removing the same. The valve 18 may be of any conventional design and may be positioned in any convenient location, in known manner.

The mattress-forming bladder 10, filled with an appropriate amount of water and confined in conventional manner (with hard or soft sides and a supporting bottom) presents a sleeping surface at its upper face. For the purposes of discussion herein, that sleeping surface may be said to have a head area 14, a foot area 15 and opposing side areas 16 and 17. Typically, a person resting or sleeping on the sleeping surface will position his or her head at the head area 14 with the body extending toward the foot area 15.

The advantages of a waterbed are attained through its manner of support of a person lying in the sleeping area. The characteristics of the waterbed mattress that provide the desired support also causes difficulty as a person enters and exits the sleeping surface. That is, a person lying on the sleeping surface who attempts to exit the bed will typically exert pressure on a localized area of the sleeping surface. However, the characteristics of the sleeping surface are such that the sleeping surface will "give" under that pressure. For most persons, this may be only a slight inconvenience. However, for the elderly or the infirm, this can severely interfere with their entry into and exit from the bed and, accordingly, the enjoyment of the waterbed. It may even result in its nonuse.

The present invention provides a waterbed having all the advantages of known waterbed constructions wherein the firmness of all or a portion of the sleeping surface may be selectively adjusted to facilitate entry and exit from the bed, as well as to selectively support different portions of the body. This is accomplished via an air chamber positioned within the liquid-containing bladder forming the waterbed mattress. In preferred embodiments, the air chamber is formed of multiple, inter-connected chambers which are selectively inflated or deflated. As illustrated in FIG. 1, a multi-chamber unit 20 is illustrated within a liquid-containing bladder 10 with the chambers extending beneath the sleeping surface from one side area to the other. In a deflated configuration, the air chamber unit merely "floats" within the mattress-forming bladder 10 without affect on the firmness of the sleeping surface. However, on inflation of the air chamber unit 20, its buoyancy will cause it to rise toward the sleeping surface and provide additional support to that portion of the sleeping surface which overlies the unit 20. The degree of buoyancy—controlled by the degree of inflation of the air chambers—controls the amount of support provided to that portion of the sleeping surface. Accordingly, the firmness of at least a portion of the sleeping surface is selectively adjusted.

Figure 2:
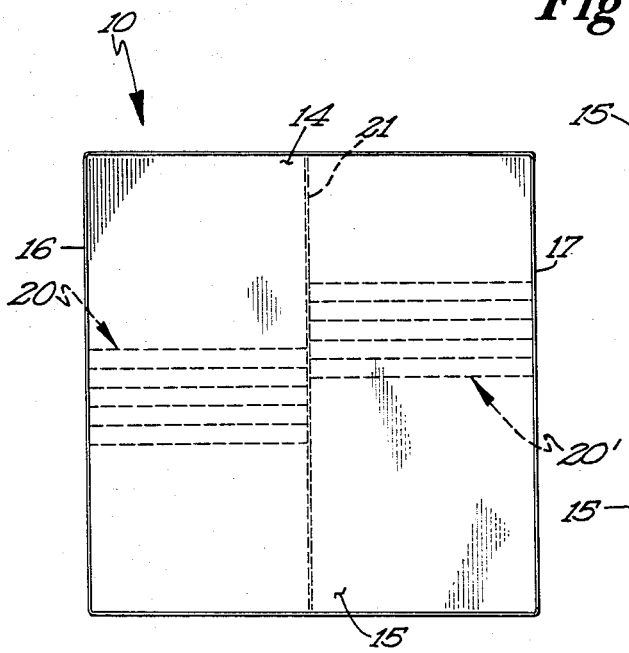
FIG. 2 is a top view illustrating alternative preferred embodiments in accordance with the present invention.

The air chamber unit 20 may be positioned within the mattress-forming bladder 10 to selectively adjust different portions of the sleeping surface. This is illustrated diagrammatically in FIG. 2 which is a top view of a waterbed in accordance with the present invention. As illustrated, the mattress-forming bladder 10 is separated by a centerline 21 which may represent an abutment between separate mattress-forming bladders, a membrane within the bladder 10 to form separate sleeping areas or may arbitrarily designate a "no-man's land" between adjacent sleeping areas for two persons. In any case, all or a portion of the sleeping surface between a side area (16 or 17) to the centerline 21 may have its firmness selectively adjustable by separate air chamber units 20 and 20' positioned on opposing sides of the centerline 21 and extending from different side areas 16 and 17 toward the centerline 21. Additionally, the air chamber units 20 and 20' may be positioned at different locations along the distance between the head and foot areas 14 and 15 to adjust the firmness of the sleeping area at different locations. Additionally, the "dual" air chamber configuration allows separate adjustment of the firmness of the sleeping areas on either side of the centerline 21 even when the air chamber units 20 and 20' are positioned symmetrically with respect to the centerline 21.

The location of the air chamber unit 20 relative to the head and foot areas 14 and 15, respectively, is dependent upon the desired use. For conventional "sleeping" circumstances, it is expected that approximately one-third of the sleeping area between the head and foot areas (14 and 15, respectively) will have its firmness adjusted in either the single or dual chamber configuration.

For most sleeping applications, the air chamber unit of the present invention will be centered under that portion of the sleeping surface that is most likely to support the torso of the person lying on that surface. As noted above, this may be either a single chamber unit extending from one side area to the other. In the dual mode, separate air chamber units may be employed with each extending from a different side area toward the other. In medical applications, air chamber units may be differently positioned, in either the single or dual configuration. For example, pressure on the lumbar region of the spine may be reduced by centering an air chamber unit under that portion of the sleeping surface intended to accept the pelvic region. Similarly, relief from a hernia may be obtained by centering an air chamber unit under that portion of the sleeping surface intended to accept the knee/calf area of the legs. These same air chamber placements may be useful for other medical conditions, as may other air chamber placements be useful for other conditions.

As illustrated, the air chamber units of the present invention are formed as multiple chamber devices which may be constructed by bonding two layers of heat-bondable material to each other. In a preferred embodiment, each of the chambers is in fluid communication with at least one other chamber such that only a single inflation/deflation port is necessary to control the inflation of all of the chambers. This construction is not unlike that found in many air mattresses and those constructions, the materials used to form them and the fabrication techniques employed to manufacture them may be employed in the construction of the present invention. It should be noted, however, that in all cases the firmness adjustment is provided by air chambers extending from one of the side areas 16 or 17 toward the other side area in a generally parallel direction to each other. While passages extending in other directions may be employed to interconnect the chambers, it is a feature of the present invention that the chambers forming the support in the intended region of the sleeping area be generally parallel to each other and extend in the indicated direction. This chamber configuration provides a uniformity of support along the length of the air chambers to and from a side area with which they are associated.

As illustrated, and as noted above, an air chamber in accordance with the present invention is a multi-chamber device with the primary supporting chambers being generally parallel to each other. As shown in FIG. 1, and in FIGS. 3–5 to be described below, multiple tubular chambers are generally coextensive with each other and lie adjacent to each other in a generally parallel relation. The multiple chambers may be formed by bonding two sheets of material to each other while allowing fluid communication from one chamber to the other. Inflation and deflation of the chambers may be via an airline 22 extending from one of the chambers to exit a mattress-forming bladder 10 at a valve **22*a*. The valve 23 may be of any conventional design which will accommodate the line 22 while providing a seal for the liquid within the mattress-forming bladder 10. As illustrated, the valve 22*a* is positioned generally in the head area of the mattress bladder, although other locations may be employed, if desired. The line 22 extends to a pump 12 via a relief valve 11. The pump 12 may be of any known design. It is presently contemplated that a "vibration" pump of the type employed with aquarium filters is suitable for most applications. The output of this pump is applied via line 22, and through the relief valve 11 to inflate the air chamber unit 20. The relief valve 11 provides protection for over-inflation of the air chamber unit 20 to prevent damage thereto. The relief valve may also be provided with a manual pressure exhaust whereby the inflated air chamber unit 20** may be deflated.

In use, and assuming a person is lying on the sleeping surface of the waterbed formed by the confined, liquid-containing bladder 10, that person will be supported by the sleeping surface as in a conventional waterbed. Should that person desire to exit the bed, he or she may initiate the pumping action of pump 12, causing air to inflate the chambers of air chamber unit 20. As a result of fluid communication, each of the chambers of unit 20 will be inflated to the same pressure level. On inflation, the buoyancy of air chamber unit 20 will cause them to support that portion of the sleeping surface that overlies them. This additional support will be dependent upon the degree of inflation of the air chambers. Accordingly, when the air chambers are sufficiently inflated to provide the necessary degree of support, the pump action may be terminated and the additional support may be employed to facilitate the person's exit from the bed. Should the person forget to terminate the pumping action, pressure relief valve 11 will prevent damage to air chamber unit 20 as a result of over inflation. It is presently contemplated that a pressure no greater than 2 pounds per square inch will be necessary to provide the necessary support. As noted above, the support may be provided at various locations on the sleeping surface dependent upon the condition it is intended to address, including medical conditions. Additionally, multiple and independent air chambers may be provided to address alternative conditions and/or multiple persons occupying the same sleeping surface.

The air chamber unit 20 illustrated in FIG. 1 will be maintained in position between the side areas 16 and 17 as a result of its length and interaction with the sides of the bladder 10. Its position between the head area 14 and foot area 15 may be maintained in any desired manner. For example, a strap extending from the underside of the top surface of the bladder and around the chamber 20 may secure the chamber 20 in the desired location. The air line 22 will provide some control of movement of the chamber unit 20 within the bladder forming the mattress 10.

Figure 3:
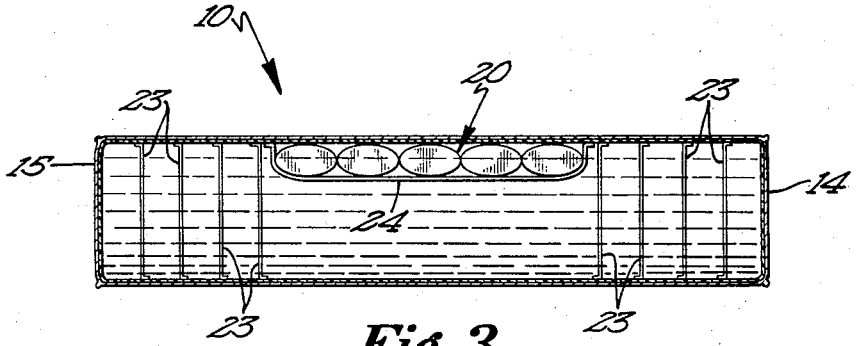
FIGS. 3–5 are alternative cross-sections as viewed along the line 3—3 in FIG. 1 of preferred constructions in accordance with the present invention.
Figure 4:
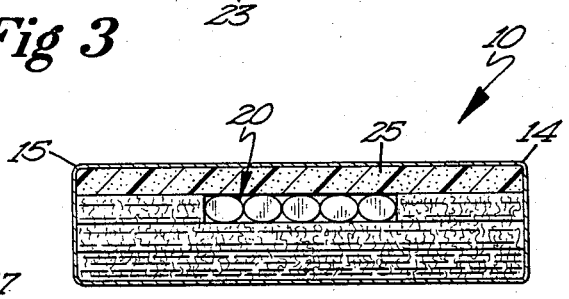
Figure 5:
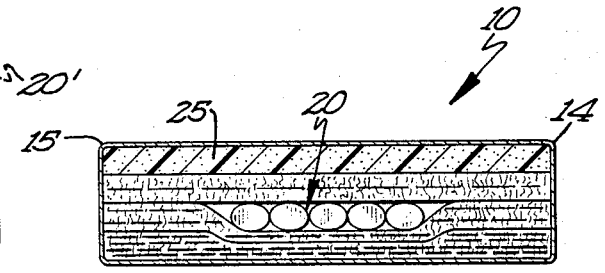

FIG. 3 illustrates a "hydraulic" waterbed mattress of a type known to the prior art wherein devices represented at 23 are supported from the underside of the sleeping surface within the bladder forming the mattress 10 to minimize wave action within the bladder. The air chamber 20 is positioned between the illustrated devices 23 and may be partially maintained in position relative to the head 14 and foot 15 by those devices. In addition, a strap 24, generally described above, may be employed to maintain the air chamber unit 20 in position relative to the head and foot. FIGS. 4 and 5 illustrate the air chamber unit 20 of the present invention in conjunction with "fiber"-type waterbed mattresses. In each of the mattresses of FIGS. 4 and 5, the top layer is formed of a foam-like material which is known to the prior art. In addition, in each of FIGS. 4 and 5, multiple layers of a sheet-like bonded fiber material is employed. The fibers in such constructions minimize or reduce wave action within the bladder forming the mattress 10. In the embodiment of FIG. 4, part of a fibrous layer is eliminated to accommodate an air chamber unit in accordance with the present invention while in the embodiment of FIG. 5, an air chamber unit in accordance with the present invention is positioned between adjacent layers of the fibrous material. In all of FIGS. 3–5 the air chamber unit 20 interacts with the particular wave reduction system to maintain the position of the unit 20.

Obviously, many modifications and variations of the present invention are possible in light of the above teachings. For example, in several of the figures, the air chamber unit of the present invention is shown as a five chamber or compartment device. Any number of compartments may be employed without departing from the scope of the present invention. In most instances, however, there will be multiple chambers to avoid a bulging of the sleeping surface being supported. That is, the use of multiple chambers or compartments within a single chamber unit provides a more uniform ("even" or level) support for that portion of the sleeping surface being supported than would be possible with a unit having a single chamber. Also, while five chambers are illustrated, any number of chambers may be employed. The dimensions of the chambers may be selected in accordance with the particular application. For a given area, a greater number of chambers will provide a more even or level support. It will likely have greater construction costs as well as longer inflation/deflation times. Such considerations may alter the ultimate configuration but all are within the scope of the present invention. It is therefore to be understood that, within the scope of the appended claims, the invention may be practiced otherwise than is specifically described.

I claim:

1. In a waterbed of the type adapted to support one or more persons on a sleeping surfaces established by a confined, liquid-containing bladder, the sleeping surface having nominal head, foot and opposing side areas, the improvement which comprises:

selectively inflatable air chamber means within said liquid-containing bladder and extending from one of said side areas toward the other of said side areas for adjusting the firmness of at least a portion of the sleeping surface between said head and foot area;

means for selectively establishing the inflation level of said air chamber means; and means within said bladder for reducing wave motion therein, said wave motion reducing means comprising fibrous material formed in multiple sheets and interacting with said air chamber means to maintain the position of said air chamber means within said bladder, said air chamber means being positioned above at least some of said sheets.

2. The waterbed of claim 1 wherein said air chamber means extend from one side area to the other side area.

3. The waterbed of claim 2 wherein said air chamber means are configured to adjust the firmness of said sleeping surface along approximately one-third of the distance from said head area to said foot area.

4. The waterbed of claim 1 wherein said air chamber means are configured to adjust the firmness of said sleeping surface along approximately one-third of the distance from said head area to said foot area.

5. The waterbed of claim 1 wherein said air chamber means comprises a plurality of elongated air chambers extending in the direction between said side areas.

6. The waterbed of claim 5 wherein said elongated air chambers are in fluid communication with each other.

7. The waterbed of claim 5 wherein said inflation level establishing means comprises selectively operable pump means having an output connected to said elongated air chambers.

8. The waterbed of claim 7 wherein said elongated air chambers are in fluid communication with each other.

9. The waterbed of claim 8 further comprising pressure relief means for relieving excessive pressure within said air chambers.

10. The waterbed of claim 1 wherein said wave motion further comprises hydraulic means.

11. A waterbed according to claim 1 and being of the type having means within said bladder for reducing wave motion therein, said air chamber means replacing a portion of said wave motion reducing means.

* * * * *

UNITED STATES PATENT AND TRADEMARK OFFICE

CERTIFICATE OF CORRECTION

PATENT NO. : 4,901,386

DATED : February 20, 1990

INVENTOR(S) : Walter W. Lane

It is certified that error appears in the above-identified patent and that said Letters Patent is hereby corrected as shown below:

In the References Cited Section, under U.S. PATENT DOCUMENTS, add the following:

| | | | |
|---|---|---|---|
| 3,879,776 | 4/1975 | Solen | |
| 4,068,334 | 1/1978 | Randall | |
| 4,068,335 | 1/1978 | Phillips | |
| 4,114,214 | 9/1978 | VonHeck | |
| 4,114,215 | 9/1978 | Santo | |
| 4,394,784 | 7/1983 | Swenson | 5/453 |
| 4,479,275 | 10/1984 | Fraige | 5/450 |
| 4,617,690 | 10/1986 | Grebe | 5/453 |
| 4,638,518 | 11/1987 | Barbulla | 5/452 |
| 4,644,597 | 2/1987 | Walker | 5/449 |
| 4,688,283 | 8/1987 | Jacobson et al | 5/449 |
| 4,707,872 | 11/1987 | Hessel | 5/451 |
| 4,723,329 | 2/1988 | Vaccaro | 5/455 |

Column 6, line 8, delete "surfaces" and insert --surface--.

UNITED STATES PATENT AND TRADEMARK OFFICE

CERTIFICATE OF CORRECTION

PATENT NO. : 4,901,386

DATED : February 20,1990

INVENTOR(S) : Walter W. Lane

It is certified that error appears in the above-identified patent and that said Letters Patent is hereby corrected as shown below:

Column 6, lines 50-55, after "motion" and insert --reducing means--.

Signed and Sealed this

Fourth Day of December, 1990

*Attest:*

HARRY F. MANBECK, JR.

*Attesting Officer*

*Commissioner of Patents and Trademarks*